US010222191B2

(12) United States Patent
Handel

(10) Patent No.: US 10,222,191 B2
(45) Date of Patent: Mar. 5, 2019

(54) COMPOSITION AND METHOD FOR BLAST HOLE LOADING

(71) Applicant: BLAST BOSS PTY LTD, Burleigh Heads (AU)

(72) Inventor: David Handel, Burleigh Heads (AU)

(73) Assignee: Blast Boss Pty Ltd, Burleigh Heads (AU)

( * ) Notice: Subject to any disclaimer, the term of this patent is extended or adjusted under 35 U.S.C. 154(b) by 9 days.

(21) Appl. No.: 15/303,210

(22) PCT Filed: Apr. 16, 2015

(86) PCT No.: PCT/AU2015/000226

§ 371 (c)(1),
(2) Date: Oct. 10, 2016

(87) PCT Pub. No.: WO2015/157804

PCT Pub. Date: Oct. 22, 2015

(65) Prior Publication Data

US 2017/0038188 A1 Feb. 9, 2017

(30) Foreign Application Priority Data

Apr. 16, 2014 (AU) ..... 2014901392

(51) Int. Cl.

| | |
|---|---|
| ***F42B 3/00*** | (2006.01) |
| ***F42D 1/20*** | (2006.01) |
| ***F42D 1/18*** | (2006.01) |
| ***F42D 1/26*** | (2006.01) |
| ***F42D 1/28*** | (2006.01) |

(52) U.S. Cl.
CPC ..... *F42D 1/20* (2013.01); *F42D 1/18* (2013.01); *F42D 1/26* (2013.01); *F42D 1/28* (2013.01)

(58) Field of Classification Search
USPC ..... 102/313; 166/259; 175/2
See application file for complete search history.

(56) References Cited

U.S. PATENT DOCUMENTS 3,063,373 A * 11/1962 Boddorff ..... F42D 1/12 102/313
3,804,182 A * 4/1974 Adair ..... E21B 7/007 175/1
3,856,095 A * 12/1974 Adair ..... E21B 7/007 175/1

(Continued)

FOREIGN PATENT DOCUMENTS

AU 718409 B2 6/1999
CA 886121 A 11/1971

(Continued)

OTHER PUBLICATIONS

Cui, Z. et al., "Water-silt composite blasting for tunneling," International Journal of Rock Mechanics & Mining Sciences, vol. 47, No. 6, Sep. 2010, Available Online Jun. 23, 2010, 4 pages.

(Continued)

*Primary Examiner* — J. Woodrow Eldred
(74) *Attorney, Agent, or Firm* — McCoy Russell LLP

(57) ABSTRACT

A method of loading a blast hole, the method comprising the step of applying a composition to a blast hole wherein the composition provides a barrier layer between an explosive loaded in the blast hole and water in the blast hole.

20 Claims, 6 Drawing Sheets

(56) References Cited

U.S. PATENT DOCUMENTS

| | | | | |
|---|---|---|---|---|
| 4,057,780 | A * | 11/1977 | Shuck | E21B 43/263 166/305.1 |
| 4,780,156 | A | 10/1988 | Sheeran et al. | |
| 5,585,593 | A | 12/1996 | Villamagna et al. | |
| 9,868,892 | B2 * | 1/2018 | Bhaduri | C09K 8/426 |
| 2016/0033249 | A1 * | 2/2016 | Alexander | F42D 3/00 405/268 |
| 2016/0145165 | A1 * | 5/2016 | Zank | C06B 21/0008 102/313 |

FOREIGN PATENT DOCUMENTS

| | | | |
|---|---|---|---|
| DE | 4244617 | A1 | 7/1994 |
| GB | 2336863 | A | 11/1999 |
| WO | 02084206 | A1 | 10/2002 |
| WO | 2012090165 | A1 | 7/2012 |

OTHER PUBLICATIONS

ISA Australian Patent Office, International Search Report Issued in Application No. PCT/AU2015/000226, Jun. 4, 2015, WIPO, 3 pages.

* cited by examiner

COMPOSITION AND METHOD FOR BLAST HOLE LOADING

CROSS REFERENCE TO RELATED APPLICATIONS

The present application is a U.S. National Phase of International Patent Application Serial No. PCT/AU2015/000226, entitles "COMPOSTION AND METHOD FOR BLAST HOLE LOADING", filed on Apr. 16, 2015. International Patent Application Serial No. PCT/AU2015/000226 claims priority to Australian Patent Application No. 2014901392, filed on Apr. 16, 2014. The entire contents of each of the above applications are hereby incorporated by reference in their entirety for all purposes.

FIELD OF INVENTION

The present invention relates to the field of blasting, particularly blasting for mining and quarrying.

In one form, the invention relates to a composition for loading into blast holes.

In one particular aspect the present invention is suitable for use as a barrier material for blast hole loading. In particular, the present invention is suitable for use in a blast hole loaded with explosives.

It will be convenient to hereinafter describe the invention in relation to above ground, open cut mining, however it should be appreciated that the present invention is not limited to that use only and can be used in other applications including underground mining and excavation.

BACKGROUND ART

It is to be appreciated that any discussion of documents, devices, acts or knowledge in this specification is included to explain the context of the present invention. Further, the discussion throughout this specification comes about due to the realisation of the inventor and/or the identification of certain related art problems by the inventor. Moreover, any discussion of material such as documents, devices, acts or knowledge in this specification is included to explain the context of the invention in terms of the inventor's knowledge and experience and, accordingly, any such discussion should not be taken as an admission that any of the material forms part of the prior art base or the common general knowledge in the relevant art in Australia, or elsewhere, on or before the priority date of the disclosure and claims herein.

Many countries have a significant economic reliance on mining, particularly above ground 'drill and blast' mining of quarry rock, ore and coal. In Australia 2,500,000 MT of explosives are used per year for mine blasting. (1 $m^3$ ANFO=0.8 MT; 1 $m^3$ emulsion explosive=1.05 MT). At an approximate cost of AUD$1,000 per MT, in 2013 this represented expenditure of AUD$2.5 billion for Australian mines.

Blasting costs consume a large portion of any mine budget. An average coal mine in the Hunter Valley, Australia will consume AUD$40-50 million per annum of explosives and any savings in terms of cost or efficiency are keenly sought.

Large scale mining in open cut mines requires extensive blasting. As a first step, a large flat area (the blast 'bench') is prepared by drilling an array of holes up to 15 meters or more in depth and up to 300 mm or more in diameter. Mining and blast engineers determine the best pattern of holes to drill, the amount and type of explosive to load in each hole, and the sequence in which the holes should be detonated. This determination is based on data including geological information and the size of broken rock required.

The mining industry typically uses two types of explosives (i) bulk explosives comprising emulsion and/or a mixture of ammonium nitrate and fuel oil (ANFO) that can be pumped or loaded into drill holes, and (ii) packaged explosives, which comprise emulsion contained within a plastic 'sausage'. The 'sausages' are of various size to suite the application and may be from 25 to 100 mm diameter and up to a meter or more in length. They are loaded into a blast hole to form a column. 'Decking' may also be used to better distribute the energy released by an explosive. Decking typically consists of one or more layers of inert material, water or air, strategically located along the column of explosive.

Wherever possible, ANFO is used because it is the least expensive option compared with bulk emulsion (more expensive) or packaged explosives (most expensive). However, ANFO has limited use in wet locations or wet holes because water ingress causes the ammonium nitrate prill to disintegrate, it degrades explosive performance and generates toxic fumes—particularly NO, $NO_2$ and CO. Many failed, incomplete or poorly performing blasts are due to water ingress into the explosive. Many attempts have been made to remove, or work around the presence of water in blast holes.

In the past, attempts have been made to create dry blast holes by soaking up all the water in the blast hole using super-absorbents, such as cross-linked acrylates or acrylamides. For example, British patent GB-2336863 describes a method wherein a chemical powder sealed in a bag is introduced to water in a blast hole, whereupon the bag dissolves, releasing the superabsorbent chemical powder that reacts with the water to form a gel. Typically the chemical powder is a superabsorbent chemical. These typically include for example, sodium polyacrylate.

Other attempts to counter the effects of water in blast holes have involved modified stemming. Blast holes are often 'stemmed' by loading an inert material onto the explosive column to contain the energy released by detonation or minimise the loss of explosive energy out of the collar of the blast hole. Crushed rock is a commonly used stemming material, but it is often inconvenient to have to quarry, crush, transport and load the crushed rock into individual blast holes. Drill cuttings, mud or clay are often used as alternatives.

Commercial stemming alternatives include gelled solutions of nitrate salts, or a formulation that contain nitrate salts, potentially causing nitrate pollution to the muck pile and adjacent ground water systems. As an alternative, Australian patent AU-718409 (corresponding to U.S. Pat. No. 5,585,593) teaches the use of stemming comprising additives such as neutralised acrylic acid polymer or a neutralised mixture of sodium silicate and silicon oxide containing material or a combination of the two. This formulation in bulk or packaged form is nitrate free and thus, avoids contamination of ground water by nitrate salts.

In another approach noted by Zhen-Dong et al (Int. J. Rock Mech. & Mining Sci. 47 (2010)1034-1037), water-silt composite has been used to stem blast holes instead of pure silt. Upon detonation, the blast wave firstly affects the inner wall of the blast hole and tangential and radial tension stresses are produced. When the tension stresses exceed the ultimate tensile strength of the rock, cracks and gaps are created. Simultaneously, a huge load is generated on the inner wall of the blast hole by the reflection of the blast wave in the water. The rock is further deformed and displaced and gaps are created in the inner wall. As the water expands the gap disappears. The energy is transmitted among the rock and the rock is broken. Finally, water vapour with residual pressure issues from the cracks and quenches some of the dust.

One of the problems associated with prior art approaches to counter the effects of water in blast holes is that the additives can only absorb a finite amount of water, and they can diffuse or otherwise be mixed into the explosive column, adversely affecting explosive performance, which is commonly called 'de-coupling'. This is a particular problem when loaded blast holes 'sleep' for an extended period of time. The 'sleeping' time is the period between loading and firing a blast hole, and can become extended due to production delays, adverse (lightning activity) weather or bad firing conditions.

Myriad environmental issues are associated with mining, particularly the blasting activities required to break up rock and ore. Some of these environmental issues are also associated with adverse events during detonation of a blast hole and these include:

- creation of unwanted fine dust ('fines'),
- noise,
- over pressure (air blast),
- excessive ground vibration,
- rifling (ejection of the explosive column to the atmosphere),
- generation of hazards such as nitrous oxide fumes and asbestos fines,
- irregular blast performance by the explosive, and
- uneven rock break at the toe and along the length of the blast hole.

The need to control dust at mine sites has led to the development of dust suppression strategies for mine access roads, ore crushers, conveyors, transfer points and stockpiles, but hitherto there has not been an efficient method for dust suppression on a mine bench following a blast. In general, mining activities are halted until bulk dust created from the blast has settled, seriously detracting from mine productivity.

Efforts have been made to address the dust problem by blanketing the mine bench with water, foam or gel immediately prior to or after a blast. However, these have proved unsuccessful due to the difficulty of quickly, efficiently and economically blanketing the enormous area of mine benches, which may cover many square kilometers.

Air and/or water decking has been used to try to improve blasting based on the theory that contained water or contained air are both very efficient at absorbing and transferring energy. For example, attempts have been made to stem blast holes by loading a deck of packaged water on top of the in-hole explosive. The packaging is necessary to avoid water degradation of the explosive, particularly ANFO explosive. As an alternative, air decking, or combinations of air and water decking have been used with mixed results.

Canadian patent application CA-886121 teaches improved suppression of dust and fume generation by stemming blast holes with a gel of high water content containing organic ingredients, a preservative and optionally a wetting agent. The patent teaches the use of a gel produced from cellulose ether, alginate or materials containing methylcellulose, carboxymethylcellulose or from a polyacrylic acid or a derivative thereof.

International patent application WO 02/084206 teaches loading of a blast hole with explosive and a highly absorbent material to absorb water located within the blast hole. Preferred highly absorbent materials include super-absorbent polymers, such as starch graft co-polymers, cross-linked carboxymethyl cellulose derivatives and modified hydrophilic polyacrylates. The highly absorbent material may be loaded into the blast hole in water soluble packages or in free flowing powdered, granular, flake or fibrous form.

International patent application WO 2012/090165 relates to stemming material comprising a super-absorbent polymer and a semi-permeable membrane, soaked with aqueous liquid before or after being loaded in the blast hole, so that it expands into contact with the blast hole walls. The super-absorbent is preferably a polyacrylamide, polyvinyl alcohol, cross-linked polyethylene oxide, polymethylacrylate or a polyacrylate salt.

Accordingly, there is a need for a composition that can be readily modified and tailored to the characteristics of specific blast holes

SUMMARY OF INVENTION

An object of the present invention is to improve blast characteristics and thus blast results.

Another object of the present invention is to inhibit water ingress into explosives loaded in a blast hole.

Another object of the present invention is to reduce the environmental impact of blasting including reduction of any one or more of the dust, ground vibration, over pressure, noise and fume.

Another object of the present invention is to improve blast efficiency.

It is an object of the embodiments described herein to overcome or alleviate at least one of the above noted drawbacks of related art systems or to at least provide a useful alternative to related art systems.

In a first aspect of embodiments described herein there is provided a method of loading a blast hole, the method comprising the step of applying a composition to a blast hole wherein the composition provides a barrier layer between an explosive loaded in the blast hole and water in the blast hole.

Typically the barrier is a physical barrier, preferably a structural layer, in the form of a semi-solid formed by reaction, absorption or adsorption of water and having a viscosity of at least 2,000 Cp, preferably at least 3,000 Cp, more preferably at least 4,000 Cp. The barrier may be chosen from a range of synthetic materials, natural materials or combinations thereof. In a particularly preferred embodiment the barrier comprises up to 100% starch, or PAM: Starch 50:50, montmorillonite clay up to 100% or blends thereof.

Preferably the composition comprises super fine powders that swell rapidly. super fine powders that swell rapidly optimally seal out water and may leave internal fine powder more or less dry to pack densely and create a structural water sealing barrier.

In a preferred aspect of embodiments described herein there is provided a method of loading a blast hole, the method comprising the step of applying a composition comprising a gelling agent to a blast hole wherein the composition provides a barrier layer between an explosive loaded in the blast hole and water in the blast hole. The gelling agent may include, for example, polyacrylamides, starch, bentonite or calcium carbonate, surfactants (anionic or non-ionic), carbo-polymers, natural polymers, synthetic polymers or other agents commonly referred to as gelling agents. Starches include, for example wheat flour, corn starch, uca an amylase or amylopectin polymer or blends thereof.

These materials may comprise the entire barrier formulation, more preferably up to 99% of the barrier formulation, although much lower quantities such as about 1 to 2 wt % polyacylamide or about 5 to 10 wt % starch may form a suitable physical barrier. The exact amount will depend on a number of factors including the nature of the water, temperature and any salt added to adjust the density.

In a preferred embodiment the composition referred to above comprises one of the following gelling agents which when mixed with water provides a composition having a viscosity of between 2,000 and 4,000 Cp:

starch 3%-5%;

carboxy methyl cellulose MMC (0.5 to 5%);

di octyl sulphosussinate (1%-2%);

organic clays (bentonite 5%-10%); or gelatine (0.1%-5%).

Typically the gel has a viscosity of 2,000 to 6,000 Cp, more preferably 2,000 to 4,000 Cp. Optimally the viscosity and density is sufficiently stiff that it does not physically break down or leak through fissures and cracks in a blast hole to contaminate the explosives or any component in the blast hole. The viscosity and density can be modified according to where the gel is to be located in the blast hole and whether it is to perform functions such as decking or otherwise forming layers in the blast hole.

Semi-solids barriers such as gels are particularly preferred because they resist leakage through cracks in the blast hole walls and do not mix/contaminate the explosives or move from the position in which they are loaded.

The semi-solid may be further modified by addition of materials such as salts to adjust the density or make them suitable for bulk or packaged loading. The density it typically adjusted to less than, or greater than water density depending on whether the barrier is to be located on top, intermediate or underneath water in the blast hole. In the past solid plugs have been used as barriers in blast holes. By contrast the barriers of the present invention react and seal at the periphery where they contact water, the interior of the barrier remaining as a gel if water migrates inwards or as a powder if a moisture seal is formed at the periphery. Optimally, the more pressure applied to the barrier, the better it plugs the blast hole.

In a preferred embodiment the barrier includes gas bubbles. For example the barrier may include air bubbles created by reaction or entrained during or after the aforementioned reaction, absorption or adsorption of water. Alternatively, air bubbles may be provided in the gel by incorporation of micro-balloons, preferably polymer micro-balloons which are well known and used in the explosives industry.

The composition may, for example, comprise a solid, preferably a powder that reacts, absorbs or adsorbs water to form the barrier. Typically the composition is bulk loaded into the blast hole where water is typically already present or finds its way into the blast hole after the composition is applied. In another embodiment the composition is loaded in packages that are water permeable so that the water in the blast hole diffuses across the packaging to react with the composition. Although much lower quantities such as about 1 to 2 wt % polyacylamide or about 5 to 10 wt % starch may form a suitable physical barrier. The exact amount will depend on a number of factors including the nature of the water, temperature and any salt added to adjust the density.

Typically the gel has a viscosity of 2000 to 6000 Cp, more preferably 3000 to 5000 Cp.

Alternatively the composition may be pre-formed in the form of a semi-solid such as a gel, colloid or the like by the addition of water prior to applying the composition to a blast hole. Typically the composition comprises from 1 to 99 wt % water. The pre-formed composition may be bulk or packaged. It may further react, absorb or adsorb water subsequent to its application to the blast hole.

In a second aspect of embodiments described herein there is provided a composition for application to an explosives blast hole, the composition comprising high molecular weight linear polyacrylamide (PAM), wherein the composition forms a barrier to water ingress to an explosive loaded in the blast hole. When the composition is loaded dry into a blast hole as a solid or finely divided solid, intended to absorb or adsorb water from extraneous or other sources, the proportion of PAM is typically from 25 to 100 wt %, more preferably from 25 to 75 wt %, or even more preferably from 40 to 60 wt %. When the composition is formulated as a gel, colloid or other semi-solid, the proportion of PAM is typically from 0.001 to 50 wt %, more preferably 0.001 to 25 wt %, or even more preferably 0.001 to 10 wt %.

Linear polyacrylamide (also referred to as poly(2-propenamide) or poly(1-carbamoylethylene)) is a polymer ($—CH_2CHCONH_2—$) formed from acrylamide subunits in a linear-chain structure. It absorbs water efficiently to form a soft gel, which has some structural integrity. Where used herein the term PAM is intended to include non-crosslinked derivatives of poly(2-propenamide) and may be anionic, cationic or non-ionic or combinations thereof.

Typically the high molecular weight linear PAM is used as a finely divided particulate, or combined with water to form a gel. However, in some applications other chemical species may be used to improve storage and handling such as flow additives. It may also be combined with other material, such as wet stemming prior to loading into a blast hole.

The high molecular weight linear PAM may be mixed with other convenient materials, either natural or synthetic. Typically the other materials are present in the formulation the proportion is typically from 0.001 to 50 wt %, more preferably 0.001 to 25 wt %, or even more preferably 0.001 to 10 wt %. In a particularly preferred embodiment it is combined with a bentonite clay such as sodium bentonite which is known to swell on contact with water.

In a third aspect of embodiments described herein there is provided a method of inhibiting water ingress to explosive in a blast hole, the method including the step of loading a high molecular weight linear PAM, into the blast hole to form at least one barrier to water ingress to the explosive.

As described previously, water ingress is undesirable because it degrades explosive performance. Water adsorbed into ANFO prill tends to cause the prill structure to collapse, eliminating the gaps and interstices essential to propagation of a detonation front through the column of explosive. Furthermore, in some ores such as pyritic shales, the ground water is acidic and can react with explosives that are left to sleep for an extended period. In some mines this has led to the highly undesirable and dangerous phenomenon of unexpected detonation. A barrier according to the present invention comprising cationic high molecular weight linear PAM may be used to inhibit ingress of acidic water.

In a fourth aspect of embodiments described herein there is provided a method of inhibiting water ingress to a column of explosive in a blast hole, the method including the step of loading the composition, into the blast hole to form at least one barrier to water ingress to the explosive.

The present invention can be adjusted to provide a system of tailoring blast hole loading to take account of the differing characteristics of a mine bench and concomitant differing characteristics of individual blast holes. For example, in one embodiment a barrier to water ingress can be formed by pre-treating the walls of a blast hole with high molecular weight linear PAM prior to loading with explosives. In another embodiment, a barrier to water ingress can be formed by loading high molecular weight linear PAM at the toe, or the top of a column of explosives, or as an intermediate layer. Thus, specific blasting needs can be addressed by adjusting the proportion and/or position of PAM along the column of explosive.

Pre-treating the walls of a blast hole with high molecular weight linear PAM can be carried out by any convenient method including spraying or pouring. The PAM may also be added to the blast hole during drilling, which has the added advantage of providing lubrication between the drill bit and the blast hole to reduce friction and improve cuttings removal. It also settles in a thin layer with the drilling mud to stabilise the blast hole walls.

The high molecular weight linear PAM may be applied to a blast hole in any convenient form including as a free flowing powder or liquid such as a gel, emulsion, colloid, suspension or solution. It may be applied in bulk, or in packages, preferably comprising of water permeable or water soluble packaging material.

Preferably, the composition forms one or more cross-sectional barriers in the column of explosive and/or along at least part of the outside length of the column of explosive. In a particularly preferred embodiment the barrier of the present invention is multi layered, applied in the form of a 'sandwich' of a gel between two particulate layers. One of the advantages of high molecular weight linear PAM is that it has structural integrity, that is, it can support some weight. Thus, ANFO prill or particulate stemming material loaded on top of the PAM barrier tends to be supported, and there is less likelihood of the prill or particles migrating through the barrier or of the barrier collapsing. By contrast cross-linked PAM has minimal structural integrity and collapses under relatively small loading.

Thus the aforementioned structural integrity also permits the present invention to be used to add structure to decking by supporting upper decking layers.

When the barrier of the present invention includes gas bubbles, typically the air bubbles will act like multiple miniature air decks. Without wishing to be bound by theory, these millions of miniature air decks may facilitate energy accumulation and improved release of blast energy. Incorporation of gas bubbles can also be used to control the barrier density. Control of density may be useful if the barrier of the present invention is to be formed within an existing water column in a flooded blast hole.

When the barrier is applied in the form of a gel, it may conveniently be made by mixing the high molecular weight linear PAM with a source of on-site water prior to being loaded in the blast hole. In a preferred embodiment of the present invention, the barrier comprises nano-sized particles of linear PAM that keep the water confined in a dense, gel plug to preserve these properties and prevent it entering the explosive.

In a fourth aspect of embodiments described herein there is provided a method of loading a blast hole including the steps of:

introducing bulk and/or packaged explosive to the blast hole, and introducing the composition of the present invention in particulate and/or liquid form to the blast hole, wherein, the composition forms a barrier to water ingress to the explosive.

Without wishing to be bound by theory it is believed that when explosive detonation initiates a shockwave the barrier of the present invention creates a pulse infusion effect that modifies the peak particle velocity (PPV) and directs the explosive energy in a more controlled manner throughout the blast hole and surrounding rock, with a longer blast shockwave to ensure a much more complete blast. The detonation exerts a very high pressure on a larger area of the blast hole walls, pushing the walls outwards with more controlled energy shattering the rock surrounding the blast hole and creating more consistent rock fragmentation. By contrast, the shockwave created by blasting techniques of the prior art tends to emit energy unevenly.

In addition, the inhibition of water ingress into the explosive column by the barrier of the present invention potentially opens up opportunities to use ANFO or ANFO/emulsion explosives in wet blast holes instead of the more water resistant (but more expensive) emulsion and packaged explosives.

Other aspects and preferred forms are disclosed in the specification and/or defined in the appended claims, forming a part of the description of the invention.

In essence, embodiments of the present invention stem from the realization that the use of a barrier material can be readily incorporated into blast hole loading to provide improved blast results. Principally the barrier inhibits water ingress that would otherwise detract from explosive performance, but it can also provide advantages that optimise blast results.

Advantages provided by the barrier and method of the present invention comprise the following:

- better containment or reduction in dust, flyrock, noise and gaseous pollutants, with less vibration,
- protection of in-hole explosives, particularly from water contamination that can detract from explosive performance,
- in water contaminated holes, can form a mechanical barrier and water seal on top of the water, providing a structural base which can immediately be used as a base for loading with explosive,
- reduction in the amount of explosive and amount of stemming required by better containing the blast and creating shockwave effect,
- decrease in the velocity of the detonation front through the rock being blasted,
- intensification, redirection and extension of explosive energy,
- reduction of blast intensity at the shock zone to minimise fines,
- improved rock fragmentation, with increased sideways pressure resulting in rock breaking up along the entire length of the drill hole from collar to toe,
- safe transport, storage and delivery to the blast hole,
- improved materials handling, including improved shovel and crusher productivity and dig-ability,
- utilises components that are readily available and economic to use in large, bulk quantities,
- consumes unwelcome, often contaminated water for a useful purpose,
- improved mining advance,
- improved occupational health and safety,
- cost effective and can be loaded into a blast hole rapidly, accommodates long sleep times in loaded blast holes.

Further scope of applicability of embodiments of the present invention will become apparent from the detailed description given hereinafter. However, it should be understood that the detailed description and specific examples, while indicating preferred embodiments of the invention, are given by way of illustration only, since various changes and modifications within the spirit and scope of the disclosure herein will become apparent to those skilled in the art from this detailed description.

BRIEF DESCRIPTION OF THE DRAWINGS

Further disclosure, objects, advantages and aspects of preferred and other embodiments of the present application may be better understood by those skilled in the relevant art by reference to the following description of embodiments taken in conjunction with the accompanying drawings, which are given by way of illustration only, and thus are not limitative of the disclosure herein, and in which.

DETAILED DESCRIPTION

Figure 1:
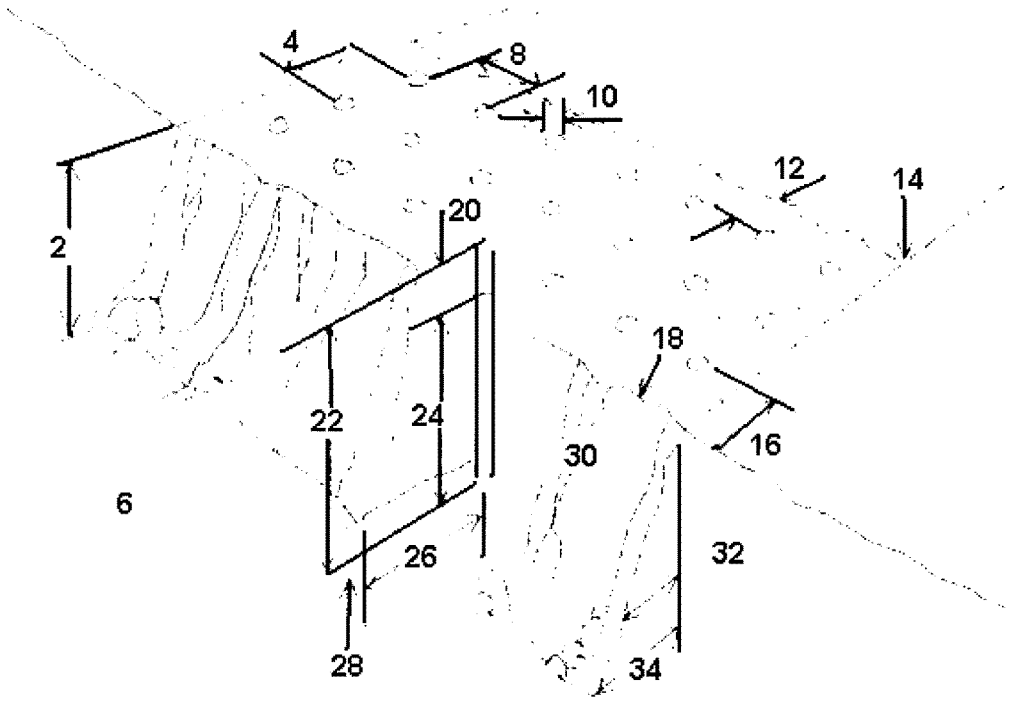
FIG. 1 illustrates in cut-away view a typical mine bench prepared for blasting.

The composition and method of the present invention is intended principally for use in blast holes of the type used for mining and quarrying, particularly above ground mining. FIG. 1 illustrates in cut-away view a typical mine bench prepared for blasting marked up to indicate the following features:

| | |
|---|---|
| 2 | Bench height |
| 4 | Drill burden |
| 6 | Floor |
| 8 | Blast hole spacing |
| 10 | Blast hole diameter |
| 12 | Back break |
| 14 | New crest (after mucking) |
| 16 | Crest burden |
| 18 | Crest |
| 20 | Stem height |
| 22 | Blast hole length |
| 24 | Explosive column height |
| 26 | Toe burden |
| 28 | Sub-drill |
| 30 | Free face |
| 32 | Face angle |

The method and composition of the present invention optionally forms a barrier to ingress of water into an explosive. FIG. 2 illustrates a cross-sectional view of simulated blast holes loaded (i) with a standard blasting configuration, (ii) with a configuration according to one embodiment of the composition and method of the present invention, and (iii) with a standard blasting configuration that has been subjected to water ingress. The blast hole loading was simulated using glass, graduated cylinders. The amount of each component loaded into the graduated cylinders was scaled to reflect the proportions used in full size blast holes.

Figures 2A, 2B, 2C:
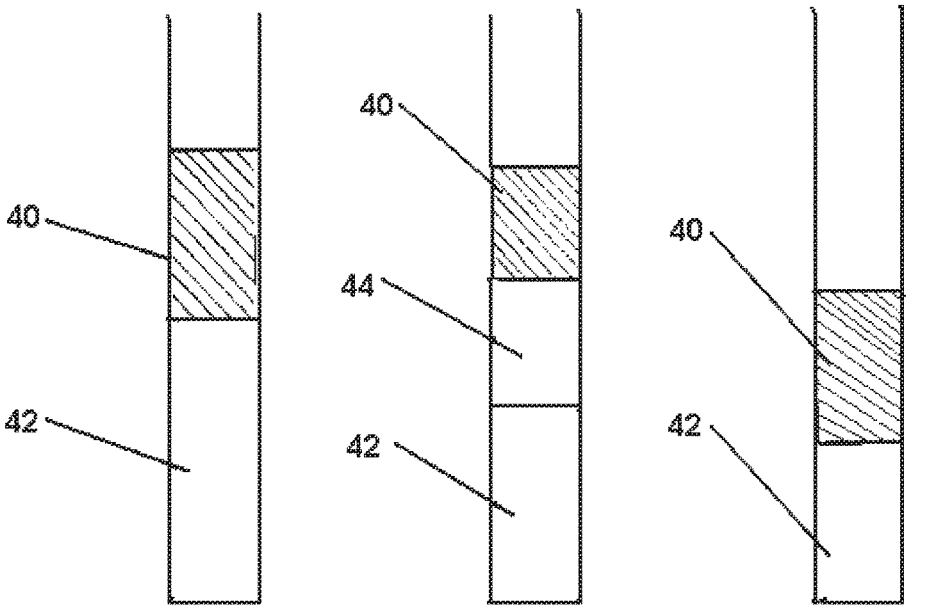
FIG. 2 illustrates a cross-sectional view of simulated blast holes loaded A with a standard blasting configuration, B with a configuration according to one embodiment of the composition and method of the present invention, and C with a standard blasting configuration which has been subjected to water ingress.

The simulated blast hole of FIG. 2A comprises particulate stemming (40) loaded on top a column of ANFO explosive (42). The simulated blast hole of FIG. 2B comprises particulate stemming (40) loaded on top a gel of high molecular weight linear PAM (44) and a column of ANFO explosive (42). The simulated blast hole of FIG. 2C comprises particulate stemming (40) loaded on top a column of ANFO explosive (42) as per FIG. 2A, following addition of water to the top of the stemming.

A comparison of FIGS. 2A and 2C illustrates how the ingress of water through the stemming (40) and into the ANFO (42) so that the ammonium nitrate has started to dissolve and the structure of the prill has collapsed. Instead of having air pockets and interstices necessary for propagation of a detonation front, the ANFO is a solid mass that would be unlikely to detonate. By contrast, the gel (44) included between the stemming (40) and ANFO (42) acts as a plug that is a barrier to water ingress to the ANFO (42) yet has sufficient structural integrity to support the stemming (40). By contrast, prior art efforts have not been directed to forming a barrier, but to super-absorb water present in the blast hole. The super-absorbents of the prior art have typically been cross-linked polymers that form lumps (rather than gels) that can work their way into the ANFO. Furthermore, they have no structural strength to support the stemming, and particles of stemming fall through and become mixed with the super-absorbents.

FIG. 3 illustrates preferred embodiments of the method of the present invention which include a barrier at the toe of the blast hole. After drilling, due to geological or meteorological factors, some blast holes collect water at the toe (base of the hole). The water will subsequently contaminate explosive loaded in the blast hole—1 meter of water in a drill hole can contaminate up to 7 meters of an explosive column. This can have disastrous affects on blast quality due to poor quality rock breaking and release of a large volume of (fume) that often contains poisonous gases such as nitrates.

Figure 3A:
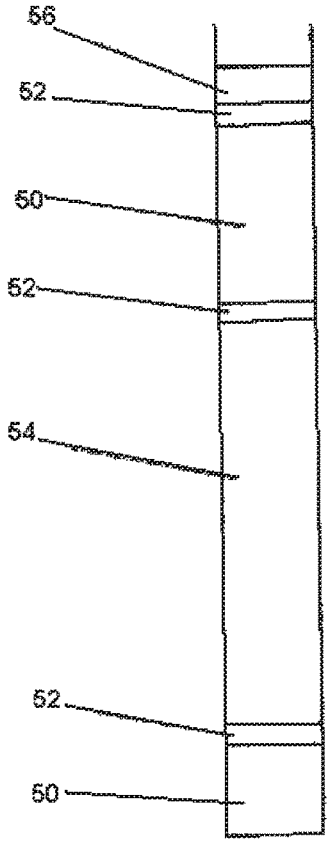
FIG. 3 illustrates preferred embodiments of the method of the present invention.

FIG. 3A illustrates in cross-sectional plan view a blast hole loaded with a high molecular weight linear PAM in gel (50) and particulate (52) form at the toe. A column of ANFO explosive (54) rests on the gel/particulate barrier (50/52). Closer to the collar of the blast hole, the top of the column of ANFO (54) is loaded with a sandwich barrier of high molecular weight linear PAM comprising a layer of gel (50) between two particulate (52) layers. Finally, a layer of stemming (56) is included at the collar.

The barrier may be formed at the toe of the wet blast hole by any convenient means. In one embodiment of the present invention, one or more bags of linear PAM are dropped down a blast hole to float on the water. The bag is made of porous or water soluble packaging that permits the linear PAM to react with the water to form a barrier. Explosives subsequently loaded onto the barrier are thus protected from the water.

Figure 3B:
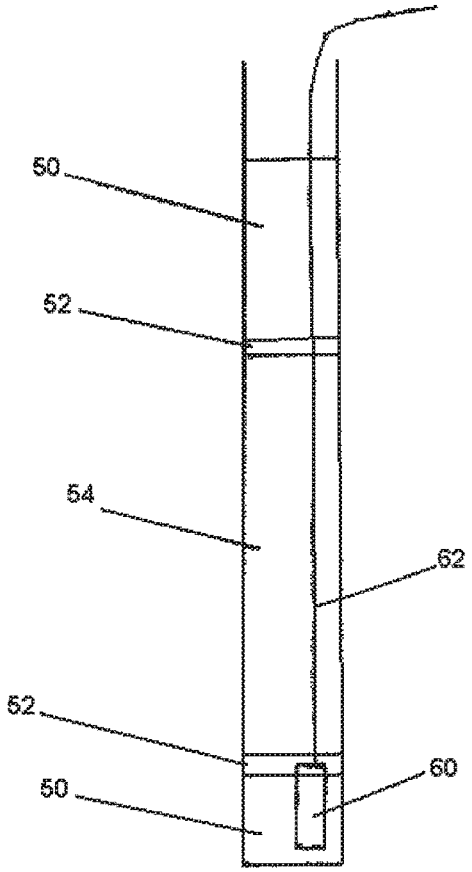
Figure 3C:
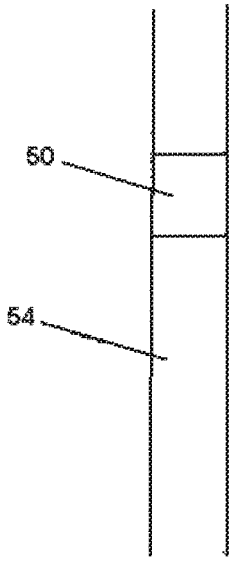
Figure 3D:
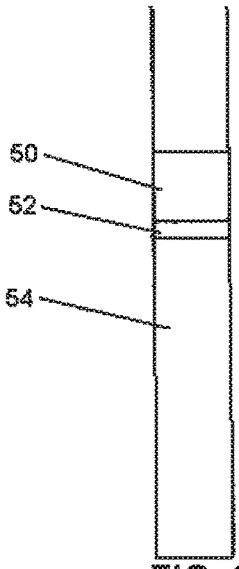

FIG. 3B is a similar illustration of another blast hole with the barrier of the present invention in gel (50) and particulate (52) form at the top and bottom of a column of ANFO (54), the blast hole loaded with a primer/detonator combination (60) at the end of a detonator cord (62). Some blasting applications, such as quarrying, may not require stemming—others may not require a barrier at the toe of the blast hole. FIGS. 3C and 3D illustrate some other alternative loadings using the barrier of the present invention that would typically be used in quarrying.

Figure 4A:
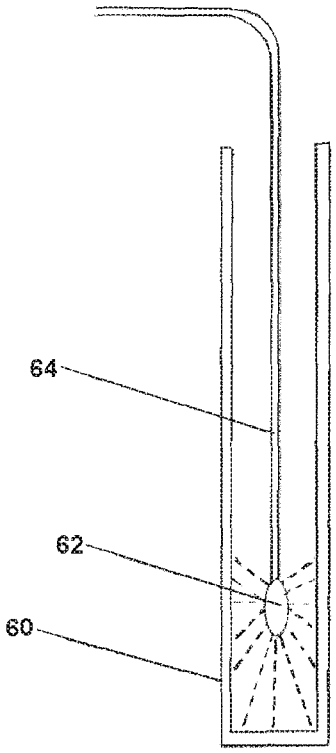
FIG. 4 illustrates further preferred embodiments of the method of the present invention.
Figure 4B:
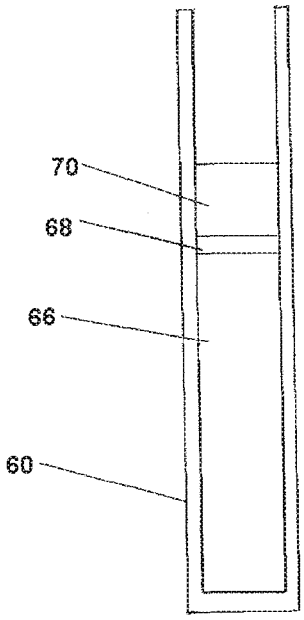

FIG. 4 illustrates further preferred embodiments according to the present invention. FIG. 4A illustrates application of a barrier (60) to the walls of a blast hole using a spray head (62) supplied with high molecular weight powder or gel pumped through a hose (64). The spray head (62) can be lowered and raised along the length of the blast hole to line part, or all of the walls. An alternative may be available to spray the powder or gel via the drill bit. Once the blast hole is lined with the barrier, it can be loaded, for example as shown in FIG. 4(*b*) with ANFO (66), and further particulate (68) and gel (70) linear PAM.

Figure 5A:
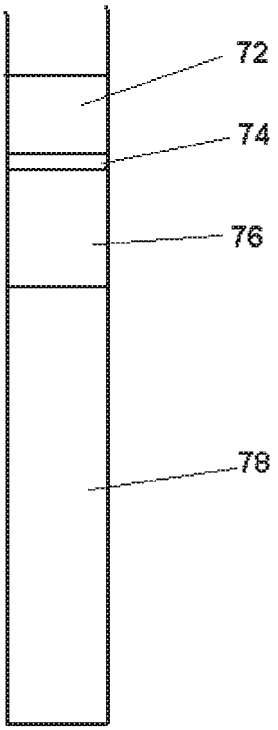
FIG. 5 illustrates a further embodiment of the method of the present invention having the barrier loaded on stemming and as a decking layer.

The present invention may further be used as FIG. 5 illustrates a further embodiment of the method of the present invention. FIG. 5A illustrates a blast hole loaded with ANFO (78) and stemming (76). The composition (74) of the present invention has been loaded onto the top of the stemming and subsequently reacted with water (72) that has collected in the blast hole. The reaction of the water (72) and composition (74) has formed a gel that prevents further water ingress so that the stemming (76) and more importantly the ANFO (78) remain dry.

Figure 5B:
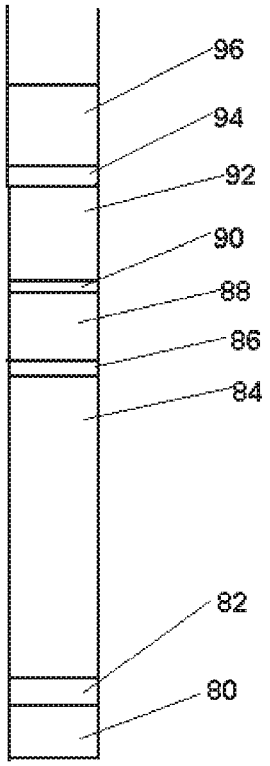

FIG. 5B illustrates the use of the barrier according to the present invention to add structure to decking layers. Decking layers of the prior art have previously comprised air, water or other inert materials. The present invention provides barriers that can contribute to decking by providing structured water layers that can support upper decking layers. Specifically FIG. 5B illustrates a decked blast hole loaded at the toe with powdered composition (80) according to the present invention, the upper layer (82) having reacted with water to form a gel barrier to water ingress to ANFO (84). The upper surface of the ANFO (84) is loaded with a 'sandwich' barrier of gel (86), powder (88) and more gel (90). The sandwich layer has sufficient structural strength to support a layer of stemming (92). A final layer (94) of gel barrier prevents ingress of water (96) that finds its way into the blast hole.

Figure 6:
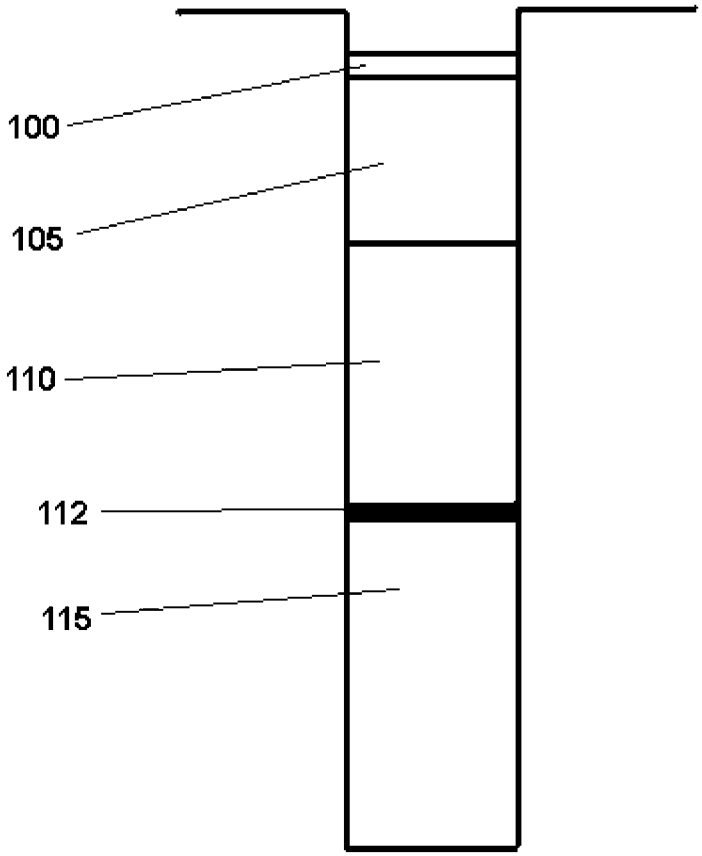
FIG. 6 illustrates the method of the present invention as applied to various aspects of blast hole loading.

FIG. 6 illustrates a blast hole which has had the composition of the present invention added to drilling water to absorb water present. When used in this manner it acts as a pre-treatment to reduce friction, increase cuttings removal, act as a barrier that seals the drill collars for dust control and stabilises the blast hole walls to resist wall collapse. The explosives (115) are loaded into the toe of the pre-treated blast hole. The barrier (112) according to the present invention forms a water and structural barrier, protecting the explosive (115) from water contamination, and creating a structural foundation on which further layers can be placed whilst minimising cross contamination of layers.

A further, thicker barrier (110) according to the present invention can improve the redistribution of energy as the detonation wave is transmitted from the column of detonated explosive. A layer of crushed rock (105) acts as stemming, capped with a further barrier according to the present invention that acts as a blast hole plug, sealing the blast hole from ingress and contamination by surface water.

Thus the barriers according to the present invention can be loaded as a very thick layer to provide a type of decking. Air and water decking are well known in the explosives industry, but it has not hitherto been the practice to combine air and water in a single deck. Thus, the barrier of the present invention can combine the advantages of air decking (compressible thus acting as an energy accumulator and works well it the upper layers of a blast hole) with the advantages of water decking (not readily compressible which intensifies the blast energy and works well in the toe and lower layers of the blast hole).

By forming or incorporating gas bubbles into the barrier it is possible to control the density of the barrier to suit the type of explosive used, the type of decking required and to optimise energy accumulation.

Controlling the density of the barrier can also be useful for loading. The barrier density can be adjusted to displace water and/or emulsion and multiple gels of different densities can be layered or used as decking. For example, one commonly used emulsion explosive has a density of 1.15 g/cm$^3$ which is higher than water (1.0 g/cm$^3$). If the barrier of the present invention is manufactured with a nominal density between these two figures (say 1.09 g/cm$^3$), this allows the barrier composition of the present invention to be loaded from the collar, displacing water in the blast hole and forms barriers.

Alternatively, barrier in the form of a gel of density 1.30 g/cm$^3$ can be pumped into an empty hole, followed by emulsion explosive having a density of 1.15 or 1.20 g/cm$^3$ then a further decking gel of density 1.10 g/cm$^3$, then a barrier and stemming. If the hole is full of water (1.0 g/cm$^3$) the alternative method would involve pumping barrier in the form of a gel of density 1.30 g/cm$^3$, then emulsion explosive having a density of 1.15 g/cm$^3$, then a decking gel of density 1.10 g/cm$^3$, then a barrier through the water on top of the gel, then stemming.

As described previously, use of the present invention can reduce the amount of explosives required for blasting as compared with prior art methods. The barrier can contain or direct the pulse of a detonation shockwave so that it releases energy more evenly in the blast hole. In particular, use of a barrier comprising a 'sandwich' of gel layer between two particulate layers of linear PAM may change the explosive pulse through the water contained in the gel. For example, in some blasting applications, use of the barrier of the present invention may allow miners to use up to about 25 wt % less explosives and up to about 50 wt % less stemming.

Typical explosive volume and cost savings achieved using the composition and method of the present invention can be exemplified with reference to Table 1. The values in the table relate to a typical coal mine in the Hunter Valley of New South Wales, Australia utilising 100,000 drill holes per annum (measuring 300 mm diameter, 15 m depth, 1.06 m$^3$ volume). The potential reduction in explosive usage is between 10 and 30%.

TABLE 1

| | Amount of explosives used (MT) | Volume of explosives used (m$^3$) | Explosives Cost (@ AUD$0.90 per kg) |
|---|---|---|---|
| Prior art method | 50,000 | 70,000 | $45,000,000 |
| Present Invention | 43,000 | 60,000 | $38,700,000 |
| Reduction | 7,000 | 9,800 | $ 6,300,000 |

(Based on a bulk density of about 0.8 tns/m$^3$ for ANFO.)

Further Example

In another example of use, the method of loading and barrier according to present invention, were trialled at a quarry bench in Toowoomba, Queensland comprising over 80 blast holes having a diameter of 102 mm, drilled to a depth of 16.5 meters. Approximately 50% of the blast holes were dry, and the remainder were wet. The blast holes were loaded with two detonators, the lower of the two detonators being located above any water in the blast hole.

The dry blast holes were loaded with a 13.5 m column of ANFO explosive and 3 m of crushed rock stemming.

The wet holes were contaminated with varying amounts of water and (all but the six test blast holes discussed below) were loaded with a 14 m column of emulsion explosive and 2.5 m of crushed rock stemming.

Six of the water contaminated holes were selected to be loaded according to the present invention. The six test blast holes held various volumes of water, from 1 to 3 meters in depth. A composition according to the present invention was slowly poured onto the water in the blast holes using a 3 m long, 80 mm diameter, purpose built funnel. A good structural barrier formed and ANFO was immediately loaded with ANFO, leaving 3 m of the blast hole empty. The height to the top of the blast hole was checked 30 mins later to confirm that the barrier had not collapsed. The blast hole was then stemmed with a 3 m column of crushed rock. Using a constant volume of stemming in blast holes holding various amounts of water meant that the length of the explosive column varied between holes.

Results: All 6 test holes detonated successfully. The barrier according to the present invention sealed the water and provided a structural, waterproof base on which ANFO could be loaded. No evidence of ANFO contamination from water was detected. In particular the stemming height did not change, and no orange fume was noticeable after detonation. Furthermore, it was apparent that even though water was sealed into the toe of a blast hole, adequate toe break was still achieved.

Compositions

Compositions according to the present invention have been successfully loaded into a blast hole according to the method of the present invention along with explosives and the blast hole detonated.

TABLE 2

| Composition 1 | Density (kg/m$^3$) | Volume (ml) | Weight (kg) |
|---|---|---|---|
| Truebond ™ MW | 900 | 500 | 4.50 |
| Magnafloc ® 1011 | 750 | 500 | 3.75 |

Composition 1 is formulated with the intention of creating a barrier in the blast hole having a thickness that is half the diameter of the blast hole (ie 102 mm blast hole requires a 50 mm thick barrier; 280 mm blast hole requires a 150 mm thick barrier).

Barrier type formulations have also been prepared using formulations comprising up to 100% starch, PAM:Starch 50:50, montmorillonite clay up to 100% and blends thereof.

TABLE 3

| Composition | Wt % | Weight (kg) |
|---|---|---|
| Magnafloc ® 1011 | 0.15% | 10 |
| Acti-Treat Extra | 1.00% | 1.5 |
| Water | Balance | Balance |
| Salt | As per density required | |

Composition 2 is formulated to achieve a viscosity of 4,000 Cp or higher and a desired density based on the application. In particular, the optimal density will depend on the size of the barrier required and the position of the barrier in the blast hole. Typically the amount of salt or other product used is added to achieve a density of between 1,000 to 1,500 kg/m$^3$. More preferably between 1,100 to 1,300 kg/m$^3$.

Magnafloc® 1011 from BASF, is a very high molecular weight anionic polyacrylamide. In acidic conditions, such as in the presence of acidic ground water, it may be preferable to mix the composition using cationic PAM or carboxymethyl celluslose (eg at 2 or 3%) with a salt added, such as magnesium chloride to adjust the density. Other PAMs will also be suitable for use with the present invention.

Truebond™ MW from Sibelco Australia Limited, is a bentonite product comprising >74% smectite, <19% quartz/cristobalite, <8% plagioclass feldspar/kaolinite. Bentonite is one of a number of forms of fine gelling clays that may be suitable for use with the present invention. Different PAM mixes with super fine clays at different ratios will perform better under different circumstances, optionally with other material added such as starch or CMC. Furthermore it is within the scope of the present invention to use a single formulation when loading a blast hole or multiple formulations.

Other gel compositions having a viscosity of between 2,000 and 4,000 Cp have been prepared using the following:

starch 3%-5%;
carboxy methyl cellulose (0.5 to 5%);
di octyl sulphosussinate (1%-2%);
organic clays (eg bentonite 5%-10%); and
gelatine (0.1%-5%).

While this invention has been described in connection with specific embodiments thereof, it will be understood that it is capable of further modification(s). This application is intended to cover any variations uses or adaptations of the invention following in general, the principles of the invention and including such departures from the present disclosure as come within known or customary practice within the art to which the invention pertains and as may be applied to the essential features hereinbefore set forth.

As the present invention may be embodied in several forms without departing from the spirit of the essential characteristics of the invention, it should be understood that the above described embodiments are not to limit the present invention unless otherwise specified, but rather should be construed broadly within the spirit and scope of the invention as defined in the appended claims. The described embodiments are to be considered in all respects as illustrative only and not restrictive.

Various modifications and equivalent arrangements are intended to be included within the spirit and scope of the invention and appended claims. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures.

"Comprises/comprising" and "includes/including" when used in this specification is taken to specify the presence of stated features, integers, steps or components but does not preclude the presence or addition of one or more other features, integers, steps, components or groups thereof. Thus, unless the context clearly requires otherwise, throughout the description and the claims, the words 'comprise', 'comprising', 'includes', 'including' and the like are to be construed in an inclusive sense as opposed to an exclusive or exhaustive sense; that is to say, in the sense of "including, but not limited to".

The invention claimed is:

1. A method of loading a blast hole, the method comprising the step of applying a composition to the blast hole, wherein the composition provides a barrier layer between an explosive loaded in the blast hole and water in the blast hole;

wherein the composition includes a gelling agent; and wherein the gelling agent comprises a high molecular weight linear polyacrylamide.

2. The method of loading a blast hole according to claim 1, wherein the barrier layer is formed by reaction, adsorption, or absorption of water by the composition.

3. The method of loading a blast hole according to claim 1, wherein the gelling agent further comprises at least one of starches, surfactants, natural polymers, synthetic polymers, and combinations thereof.

4. The method of loading a blast hole according to claim 3, wherein the gelling agent further comprises at least one of wheat starch, corn starch, carboxy methyl cellulose, di octyl sulphosussinate, organic clays, gelatine, high molecular weight linear polyacrylamide, or combinations thereof.

5. The method of loading a blast hole according to claim 1, wherein the barrier layer comprising the high molecular weight linear polyacrylamide is a solid particulate, a liquid, or a combination thereof.

6. The method of loading a blast hole according to claim 1, wherein the composition is a solid particulate comprising from 25 to 100 wt % of high molecular weight linear polyacrylamide.

7. The method of loading a blast hole according to claim 1, wherein the composition is a semi-solid comprising from 0.001 to 50 wt % high molecular weight linear polyacrylamide.

8. The method of loading a blast hole according to claim 1, wherein the composition further includes air bubbles.

9. The method of loading a blast hole according to claim 8, wherein the air bubbles are included in the composition by reaction, entrainment, incorporation as microballons, or combinations thereof.

10. The method of loading a blast hole according to claim 1, wherein the composition further includes one or more natural materials.

11. The method of loading a blast hole according to claim 10, wherein a proportion of the natural materials in the composition from 0.001 to 50 wt %.

12. The method of loading a blast hole according to claim 1, wherein the composition has a viscosity of 2,000 to 6,000 Cp.

13. A method of inhibiting water ingress to a column of explosive in a blast hole, the method including the step of loading the composition of claim 1 into the blast hole to form at least one barrier to water ingress to the explosive.

14. The method according to claim 13, wherein the composition is loaded as packages.

15. The method according to claim 13, wherein the composition is bulk loaded.

16. The method according to claim 13, wherein the at least one barrier is located at a top, at a bottom, or intermediate the column of explosive.

17. A method of loading a blast hole including the steps of:

introducing explosive to the blast hole, and introducing the composition of claim 1 to the blast hole, wherein the composition forms a barrier to water ingress to the explosive.

18. The method of loading a blast hole according to claim 17, wherein the composition is applied to walls of the blast hole prior to the step of introducing the explosive to the blast hole.

19. The method of loading a blast hole according to claim 18, wherein the composition is applied to a top surface of the explosive after the step of introducing the explosive to the blast hole.

20. The method of loading a blast hole according to claim 17, further comprising the step of introducing decking to the blast hole, wherein the composition is introduced to the blast hole prior to introducing the decking.

* * * * *